US012728453B2

(12) United States Patent
Luetkemeyer et al.

(10) Patent No.: US 12,728,453 B2
(45) Date of Patent: Sep. 8, 2026

(54) METHOD FOR PRODUCING A MOTOR VEHICLE COMPONENT BY HOT-FORMING WITH INTEGRATED CUT

(71) Applicant: BENTELER AUTOMOBILTECHNIK GMBH, Paderborn (DE)

(72) Inventors: Oliver Luetkemeyer, Paderborn (DE); Josef Koester, Paderborn (DE)

(73) Assignee: BENTELER AUTOMOBILTECHNIK GMBH, Paderborn (DE)

( * ) Notice: Subject to any disclaimer, the term of this patent is extended or adjusted under 35 U.S.C. 154(b) by 270 days.

(21) Appl. No.: 18/232,081

(22) Filed: Aug. 9, 2023

(65) Prior Publication Data

US 2024/0123486 A1 Apr. 18, 2024

(30) Foreign Application Priority Data

Aug. 10, 2022 (EP) ..... 22189765

(51) Int. Cl.

| | |
|---|---|
| ***B21D 28/26*** | (2006.01) |
| ***B21D 22/02*** | (2006.01) |
| ***B21D 22/06*** | (2006.01) |
| ***B21D 22/20*** | (2006.01) |
| ***B21D 22/22*** | (2006.01) |

(Continued)

(52) U.S. Cl.

CPC ..... *B21D 28/26* (2013.01); *B21D 53/88* (2013.01)

(58) Field of Classification Search

CPC ..... B21D 28/26; B21D 53/88; B21D 22/06; B21D 22/208; B21D 22/22; B21D 35/001; B21D 35/002; B21D 24/16; B21D 37/16; B21D 22/02; B21D 28/14; B21D 43/28; C21D 2261/00; C21D 1/18; C21D 1/673; C21D 7/13

See application file for complete search history.

(56) References Cited

U.S. PATENT DOCUMENTS

2016/0281185 A1 9/2016 Graf et al.

FOREIGN PATENT DOCUMENTS

| | | |
|---|---|---|
| CA | 2899970 A1 | 10/2014 |
| CN | 105855380 A | 8/2016 |

(Continued)

OTHER PUBLICATIONS

English translate (DE102018215545B4), retrieved date Jul. 9, 2025.*

(Continued)

*Primary Examiner* — Mohammed S. Alawadi

(74) *Attorney, Agent, or Firm* — HAUPTMAN HAM, LLP

(57) ABSTRACT

A method of making a motor vehicle component by hot-forming, hot-cutting, and press-hardening a plate made of a hardenable steel sheet alloy, heating to a temperature greater than Ac1, inserting in a combined forming and cutting tool, fixing the inserted plate in the forming and cutting tool using a stamp which is arranged in the inner region of the tool, at least partially circumferential edge cutting before beginning the forming operation or during a time period of up to 50% of the forming progression and/or at least 20% of the press stroke prior to the bottom dead center position, and hot-forming in a press stroke with the edge cut and optional press-hardening.

19 Claims, 11 Drawing Sheets

(51) Int. Cl.

| | |
|---|---|
| ***B21D 24/16*** | (2006.01) |
| ***B21D 28/14*** | (2006.01) |
| ***B21D 35/00*** | (2006.01) |
| ***B21D 37/16*** | (2006.01) |
| ***B21D 43/28*** | (2006.01) |
| ***B21D 53/08*** | (2006.01) |
| ***B21D 53/88*** | (2006.01) |
| ***C21D 1/18*** | (2006.01) |
| ***C21D 1/673*** | (2006.01) |
| ***C21D 7/13*** | (2006.01) |

(56) References Cited

FOREIGN PATENT DOCUMENTS

| | | | | |
|---|---|---|---|---|
| CN | 109072322 A | | 12/2018 | |
| DE | 102011110597 A1 | * | 7/2012 | ..... B21D 37/16 |
| DE | 102018215545 B4 | * | 8/2020 | ..... B21D 37/12 |
| DE | 102020201407 A1 | | 8/2021 | |
| DE | 102020201407 B4 | * | 12/2022 | ..... B21D 24/16 |
| EP | 3072980 A1 | | 9/2016 | |

OTHER PUBLICATIONS

English translate (DE102020201407B4), retrieved date Jul. 10, 2025.*

English translate (DE102011110597A1), retrieved date Jul. 10, 2025.*

Extended European Search Report for European Application No. 22189765.5 mailed Jan. 27, 2023; 16pp.

Office Action for German Application No. 22 189 765.5 mailed Jun. 15, 2023; 11pp.

Office Action in CN Application No. 202310981894.6 mailed Mar. 17, 2026; 13pp.

* cited by examiner

METHOD FOR PRODUCING A MOTOR VEHICLE COMPONENT BY HOT-FORMING WITH INTEGRATED CUT

RELATED APPLICATIONS

The present application claims priority of European Application Number 22189765.5 filed Aug. 10, 2022, the disclosure of which is hereby incorporated by reference herein in its entirety.

FIELD

The present disclosure relates to a method for producing a motor vehicle component by hot-forming and hot-cutting.

BACKGROUND

A sheet metal plate made of a hardenable steel alloy is heated to a temperature above the Ac1 or Ac3 point. The plate which has been heated in this manner is then inserted in a forming tool and formed in the hot state. Subsequently, the forming tool is kept closed during a direct hot-forming process and rapidly cooled so that the formed plate is hardened. In this instance, tensile strengths of more than 1400 MPa are possible. The feature is that the hardened material structure is able to be mechanically reprocessed with great complexity. This great complexity involves, for example, an edge cut. The edge cut, in order to achieve a high level of precision of the component, is carried out in most cases after the forming method. The component precision is thereby precise with regard to the outer contour. However, the plate which has already been hardened is able to be processed with structural complexity and high abrasive wear of the tool which is problematic. Laser-cutting also leads to a high expenditure in the production or manufacture of the component. A cold cut on hardened components is not recommended as a result of the risk of (micro) cracks.

The problem of edge cutting is in some circumstances reinforced as another specific feature when the plates have different wall thicknesses, for example, with tailor welded blanks (TWB), which plates are welded together from different wall thicknesses or steel alloys. Weld seam overhangs, weld seam shrinkage (inward indentation) beyond the plate edge contour or also a plate offset between the two plates which are connected to each other are problematic and in some instances require trimming after the TWB are welded together.

SUMMARY

An object of the present disclosure is to set out a possible method of producing a component by means of hot-forming in a cost-effective manner and at the same time increased precision.

The object mentioned above is achieved according to the disclosure with a method for producing a motor vehicle component by hot-forming and hot-cutting.

The method according to at least one embodiment of the disclosure is used to produce a motor vehicle component. The motor vehicle components are able to be, for example, a motor vehicle B-pillar, a motor vehicle pillar, a tunnel-like member, a bumper or bumper bracket, or the like. Flange-free reinforcement components which are at least partially U-shaped in cross section are also able to be produced, as such components are able to be used as insertion components or patches in order to reinforce the above-mentioned components internally or externally and to form a local dual metal sheet layer. They are produced by means of hot-forming and hot-cutting and optionally press-hardening in a combined tool. All this is carried out in one press stroke.

The method according to at least one embodiment of the disclosure has the following method steps:

- providing a plate made of a hardenable steel sheet alloy,
- complete heating to a temperature greater than Ac1, greater than Ac3,
- inserting in a combined forming and cutting tool,
- fixing the inserted plate in the forming and cutting tool using a stamp which is arranged in the inner region of the tool,
- at least partially circumferential edge cutting before beginning the forming operation or during a time period of up to 50% of the forming progression and/or at least 20%, or more than 30% of the press stroke prior to the bottom dead center position,
- hot-forming in a press stroke with the edge cutting and press-hardening.

According to at least one embodiment of the disclosure, the plate which has been inserted is already guided through before the beginning of the forming operation or in the initial time of the forming operation and the cut is completed in this time period.

A vertical cutting movement is carried out exclusively at the edge cutting. The cutting tool itself is driven exclusively by means of the press stroke itself. There are no additional active drives exclusively for the cutting tool. There is also no wedge-like cross slide. A cut in a horizontal direction does not take place.

As a result of these measures according to at least one embodiment of the disclosure, components which are C-shaped or hat-shaped in cross section with high tolerance requirements are able to be produced. Components are also able to be produced from tailor welded blanks or plates having different regions with a different wall thickness. In this instance, no finishing cut has to be carried out as a tolerance cut. Insertion tolerances with respect to a separate pre-insertion in the hot-forming tool and a previously occurring simple plate cut are also dispensed with.

Forming components which are U-shaped or C-shaped in cross section are also able to be produced. Flange-free components which, as a result of the vertical orientation of the U-shaped or C-shaped members, would not be able to be cut in a press after the forming operation has been completed or only with a high degree of complexity.

The method makes provision for the plate to be inserted in the hot-forming tool at a temperature greater than 500° C., or greater than 550° C. The plate is also able to be inserted in the hot-forming tool at a temperature greater than Ac1 or greater than Ac3. Depending on the steel alloy used, the Ac temperature is greater than 700° C., the Ac3 temperature is greater than 900° C.

So that the plate is fixed in position, there is arranged on the upper tool a stamp which precedes the upper tool. The plate which is inserted in the hot-forming tool is placed on a lower molding jaw. The stamp is then lowered onto the plate and clamps the plate between the stamp and lower molding jaw in a state fixed in position. The hot-cutting operation is then carried out. This is able to be carried out before the beginning of the actual forming operation.

The hot-cutting operation is carried out as an at least partial to completely circumferential edge cut of the plate. To this end, an externally circumferential cutting tool is provided on the actual hot-forming tool. The edge cut is also able to be carried out completely in such a manner that initially a partially circumferential plate cut is carried out, before the plate is heated. During the hot-cutting operation in the local forming tool, the remaining edge cut is then carried out so that overall a completely circumferential edge cut is carried out. No subsequent edge cut is necessary. No lasering or hard-cutting is necessary.

The cutting tool is able to be arranged completely relative to the upper tool and lower tool. The cutting tool is also able to be integrated in the upper tool and/or the lower tool, in an upper molding jaw and/or in a lower molding jaw.

Alternatively to a complete edge cut prior to the beginning of the forming operation, the edge cut is also able to be carried out at a first time or first phase of the forming operation. The edge cut is carried out when the plate itself is still completely in a planar horizontal state or has a slight degree of forming. This is during a time period of less than 50%, less than 30%, or less than 20% of the forming progression.

In at least one embodiment of the disclosure, this time period is also able to be based on the overall press stroke which has been carried out by the upper tool and lower tool with respect to each other. The cutting operation is begun and terminated at least 20%, more than 30%, or more than 50% of the press stroke before the bottom dead center position is reached, with a completely closed forming tool. This means, in the case of 50%, that the edge cut is terminated when the upper tool is lowered onto the lower tool, with respect to the entire press stroke, that this stroke has progressed to a maximum of 50% and before the press stroke reaches the bottom dead center position of the forming tool.

Following the edge cut, the hot-forming operation is then carried out or terminated and an optional press-hardening takes place, when a hardenable steel alloy is used.

The edge cut severs the plate completely in terms of the wall thickness thereof.

The edge cut is carried out at a temperature of from 550° C. to 700° C. According to the disclosure, this temperature, depending on the steel alloy used, an optimum level of cutting capability of the steel and abrasive wear on the cutting tools is produced, also in the material structure which is produced at the cutting edge.

If the edge cut has been carried out, the cut plate which is intended to be formed is drawn into the interior of the mold hollow space which is produced. The members, which may be bent, of the motor vehicle component or formed component which is produced are able to extend in a vertically orientated manner so that where applicable no vertically orientated cut would be able to be carried out.

This is achieved according to the disclosure by a preceding edge cut in the horizontal state of the plate.

The edge cut is terminated at least 20 mm, more than 30 mm, more than 50 mm, more than 80 mm, and more than 100 mm before reaching the bottom dead center of the hot-forming tool.

In the context of this patent, the terms hot-forming tool and hot-cutting tool are also used for the forming and cutting tool.

BRIEF DESCRIPTION OF THE DRAWINGS

Other advantages, features, properties, aspects of the present disclosure are set out in the following description.

They provide a simpler understanding of the disclosure. In the figures.

DETAILED DESCRIPTION

Figure 1A:
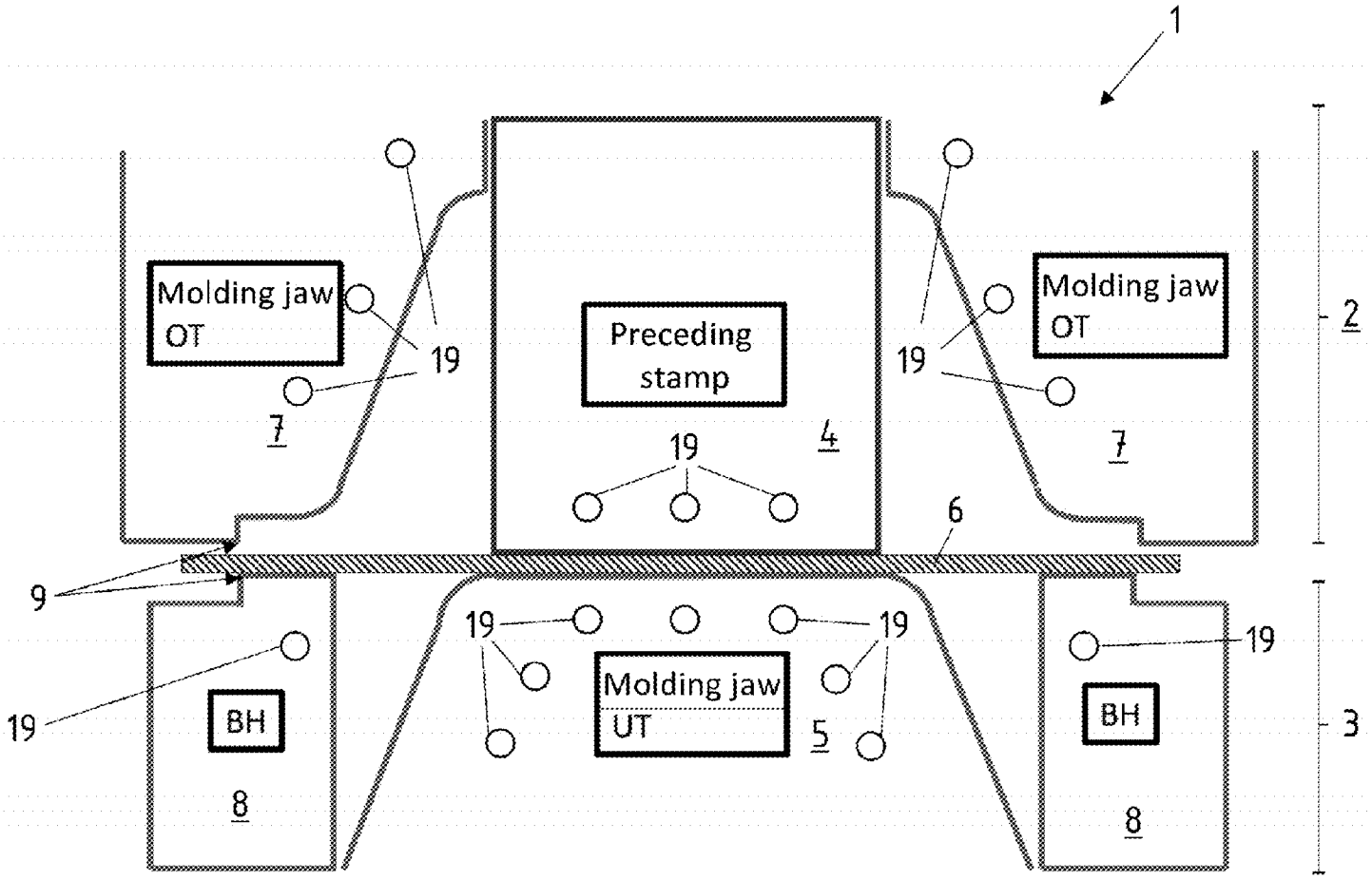
FIGS. 1A-1C show a forming and cutting tool according to an embodiment of the disclosure.

In the Figures, the same reference numerals are used for identical and similar components, even if a repeated listing is omitted for reasons of simplicity.

Figure 1B:
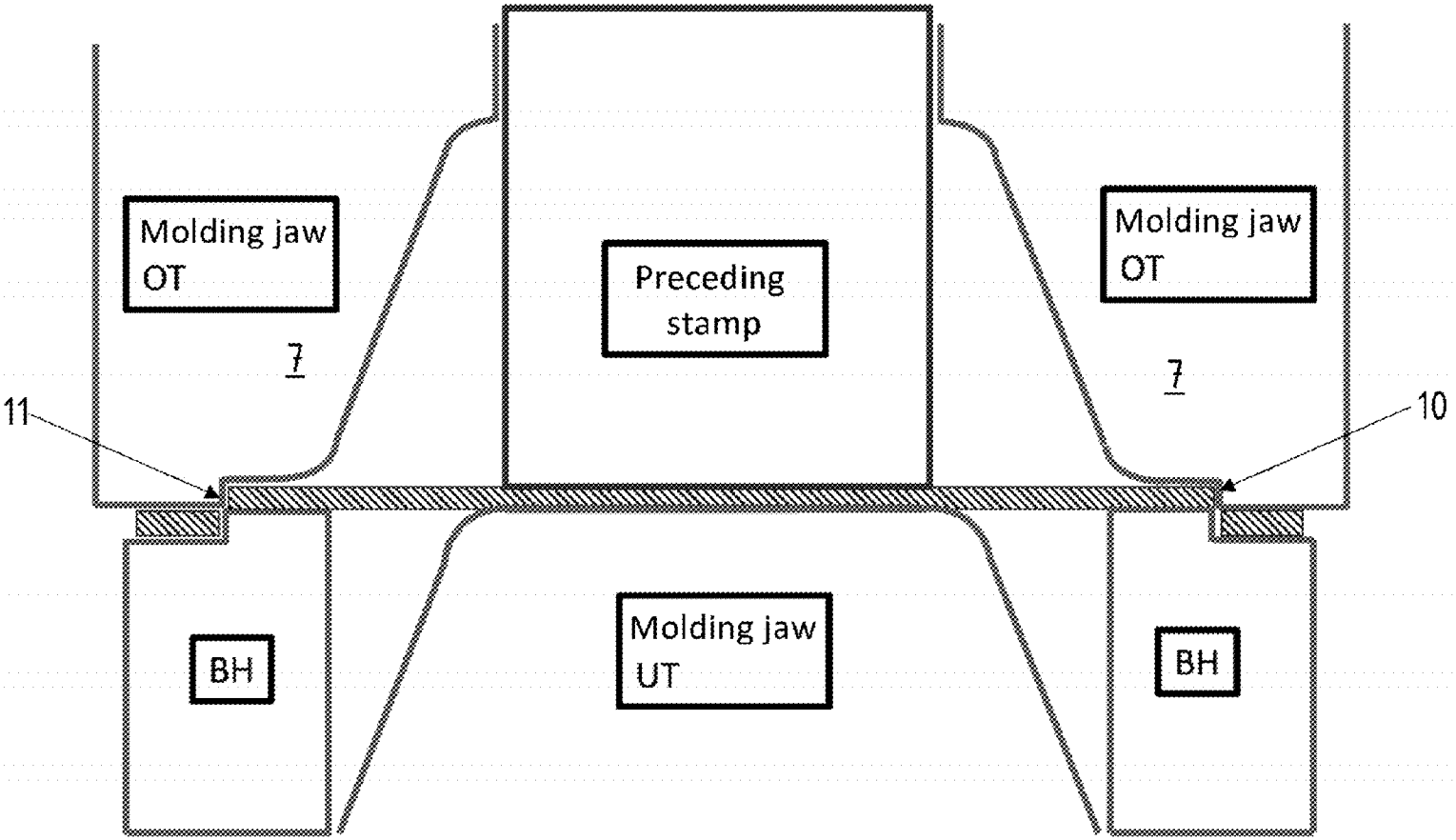
Figure 1C:
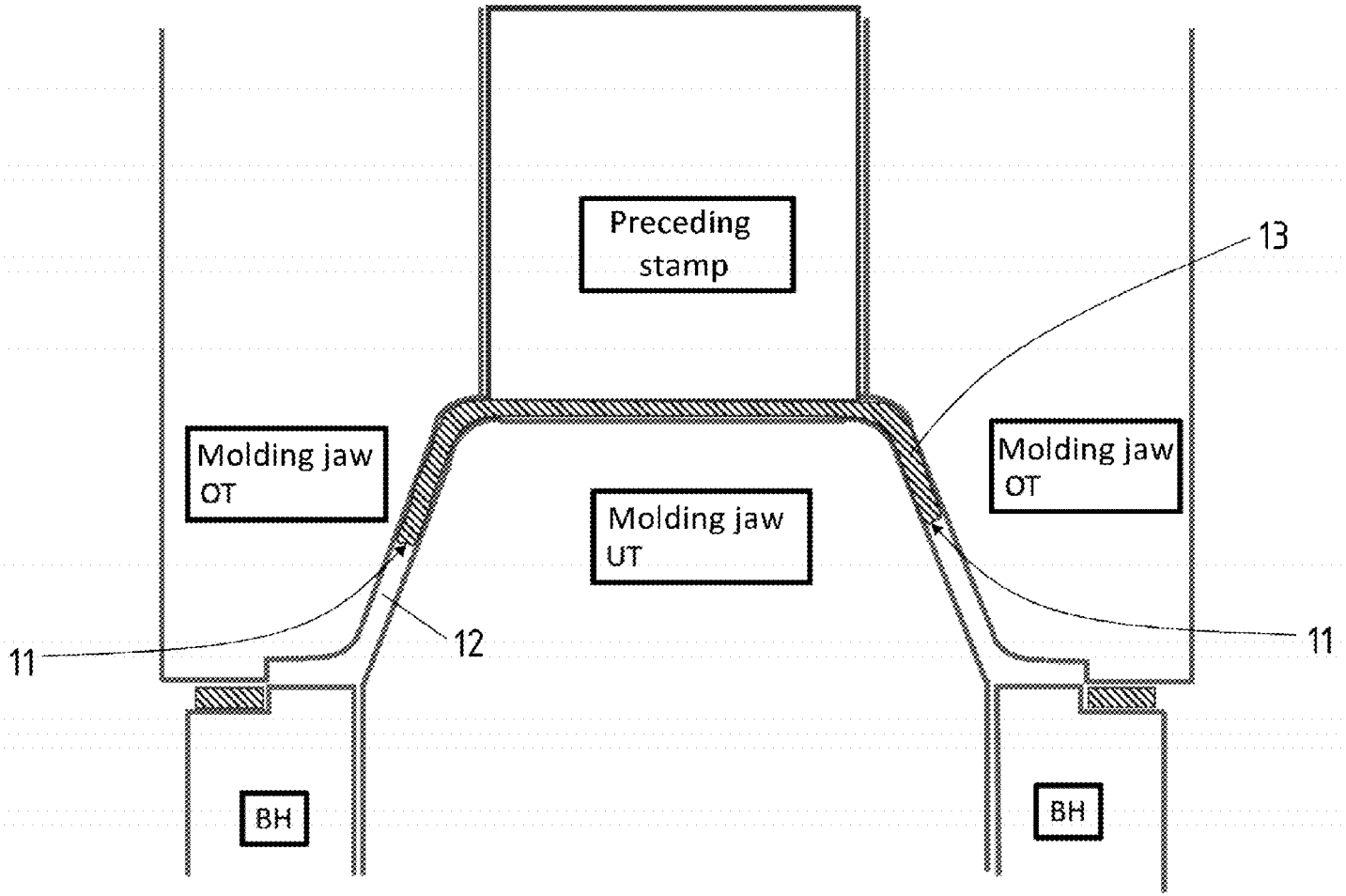

FIGS. 1A-1C show a forming and cutting tool 1 according to the disclosure. The forming and cutting tool 1 has to this end an upper tool 2 and a lower tool 3. In the upper tool 2 itself there is arranged a preceding stamp 4 which clamps a plate 6 which is placed on a lower molding jaw 5 of the lower tool 3 thereon. The preceding stamp 4 has been previously lowered. The plate 6 is fixed in position and no longer is able to be displaced in a horizontal direction H. On an upper molding jaw 7, which is a component of the upper tool 2, and a lower metal sheet holder 8, which is a component of the lower tool 3, correspondingly opposing cutting edges 9 are now arranged.

By further lowering, illustrated in FIG. 1B, the upper molding jaw 5, an edge cut 10 is carried out. The edge cut 10 corresponds in this instance to the subsequent externally circumferential component edge 11, illustrated in FIG. 1C.

At the time of FIG. 1B, the forming operation itself has not yet begun. However, the edge cut 10 has been carried out completely. By lowering the upper molding jaw 7 further, the metal sheet holder 8 is lowered relative to the lower molding jaw 5. According to FIG. 1C, the forming operation is then carried out in a molding hollow space 12 which is produced. The forming operation is illustrated in the completed state and results in a flange-free motor vehicle component 13 which is U-shaped in cross section at least over portions of the length. The motor vehicle component 13 is produced from the plate 6 which is intended to be formed. The plate 6 has to this end been drawn into an interior of the forming tool or into an interior of the molding hollow space 12.

FIG. 1A shows cooling channels 19 which are able to be provided to cool all the tool components which are in contact with the formed plate in order to carry out the press-hardening. The cooling channels 19 are not shown in the other FIG. 1B-FIG. 4B but are provided on the tool.

Figure 2A:
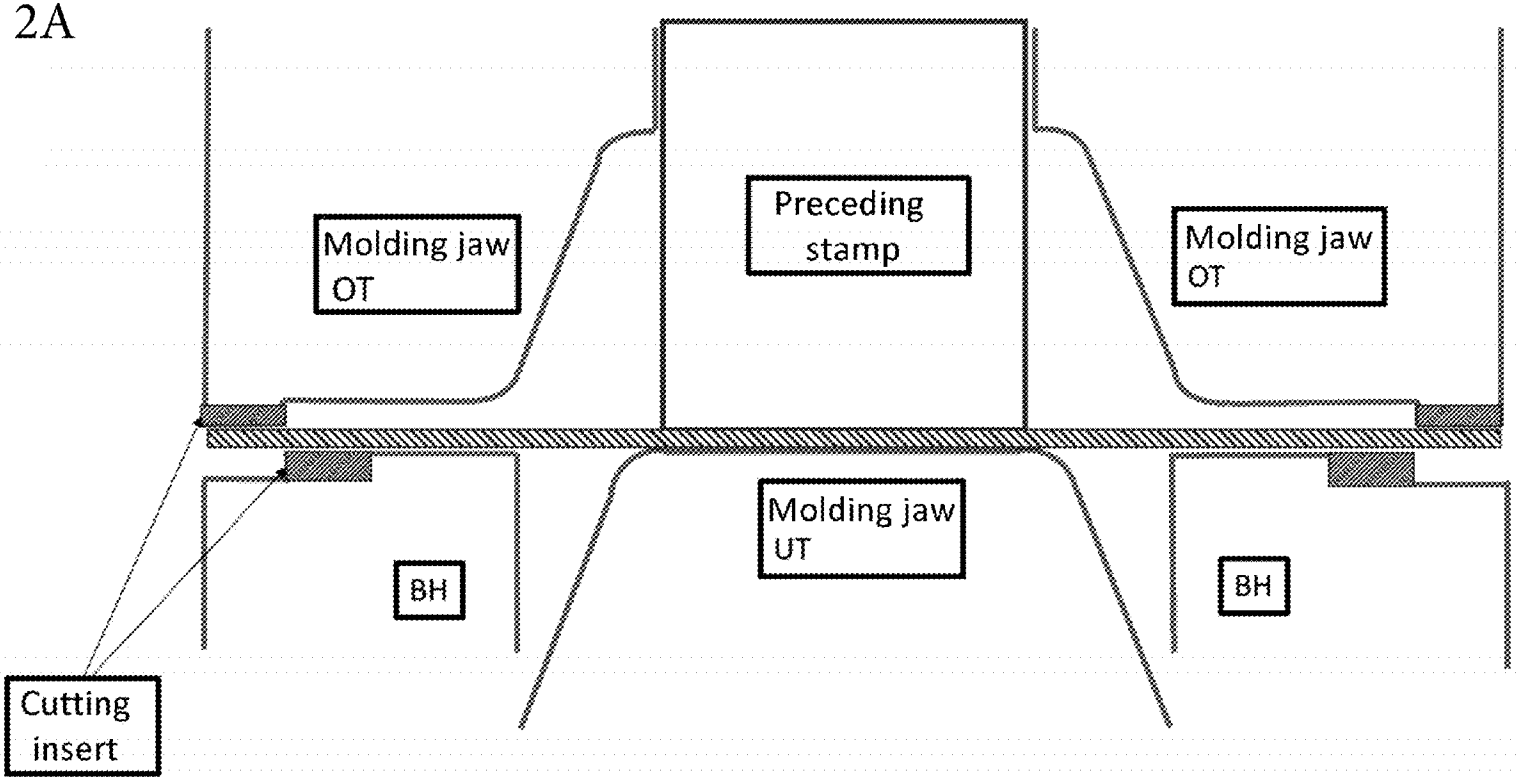
FIGS. 2A-2C show modifications with respect to FIGS. 1A-1C according to an embodiment of the disclosure.
Figure 2B:
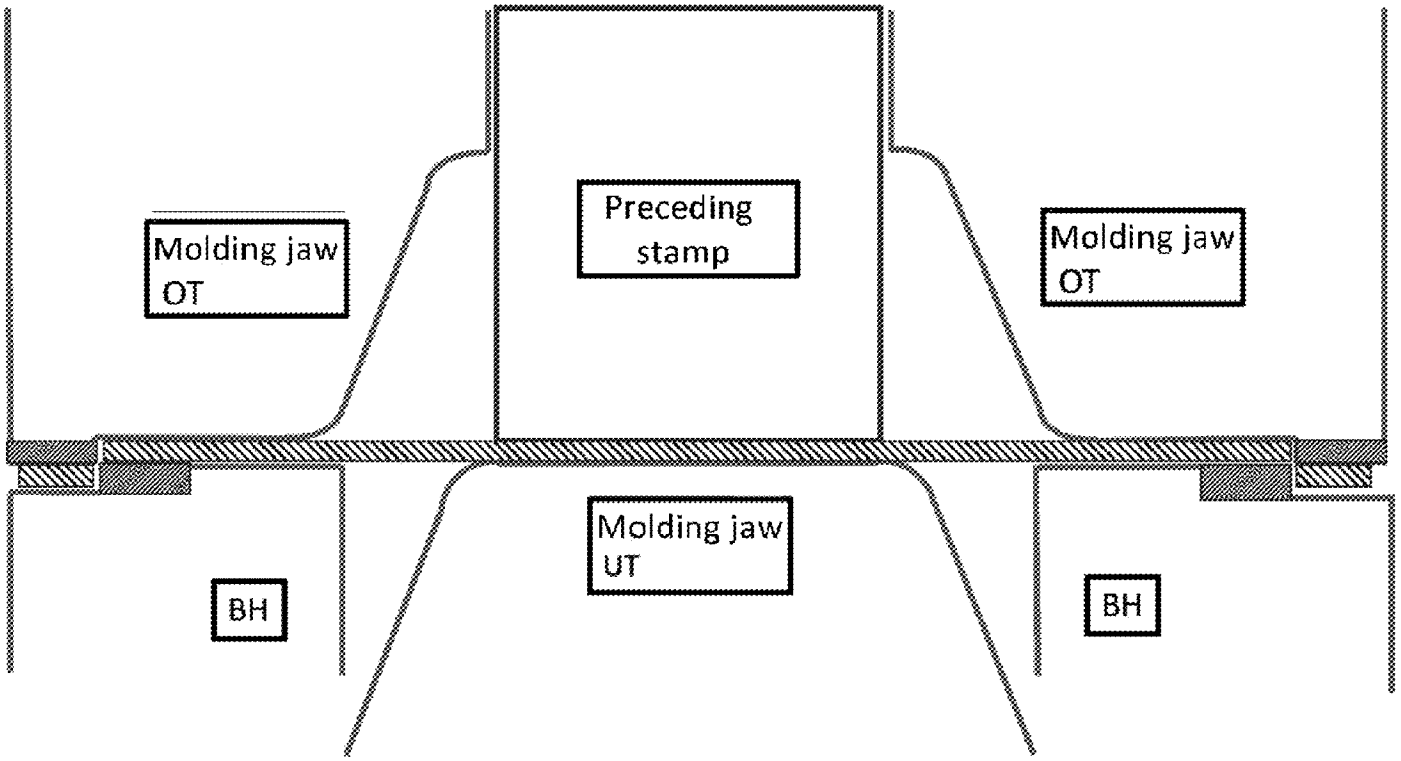
Figure 2C:
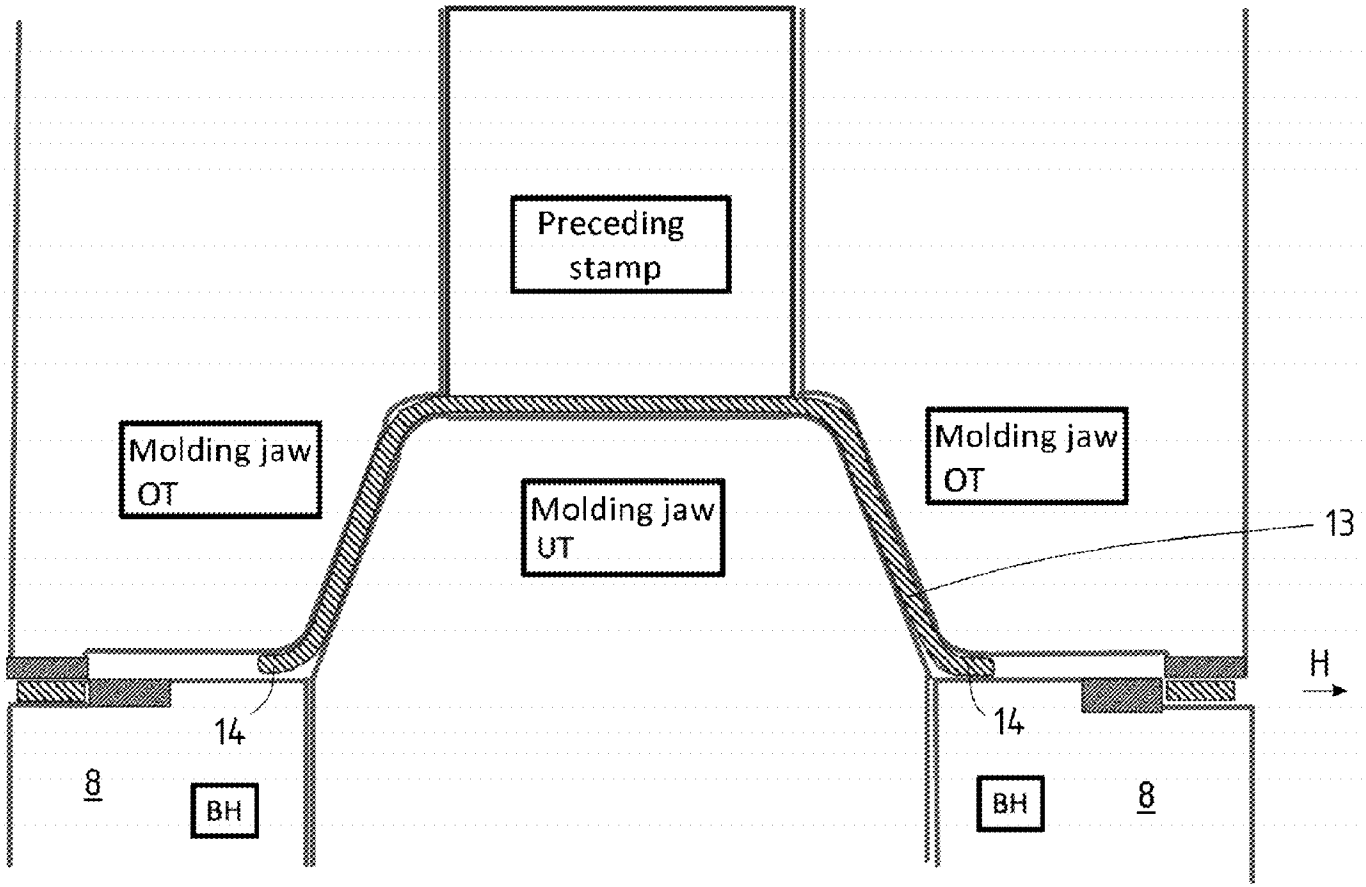
Figure 3A:
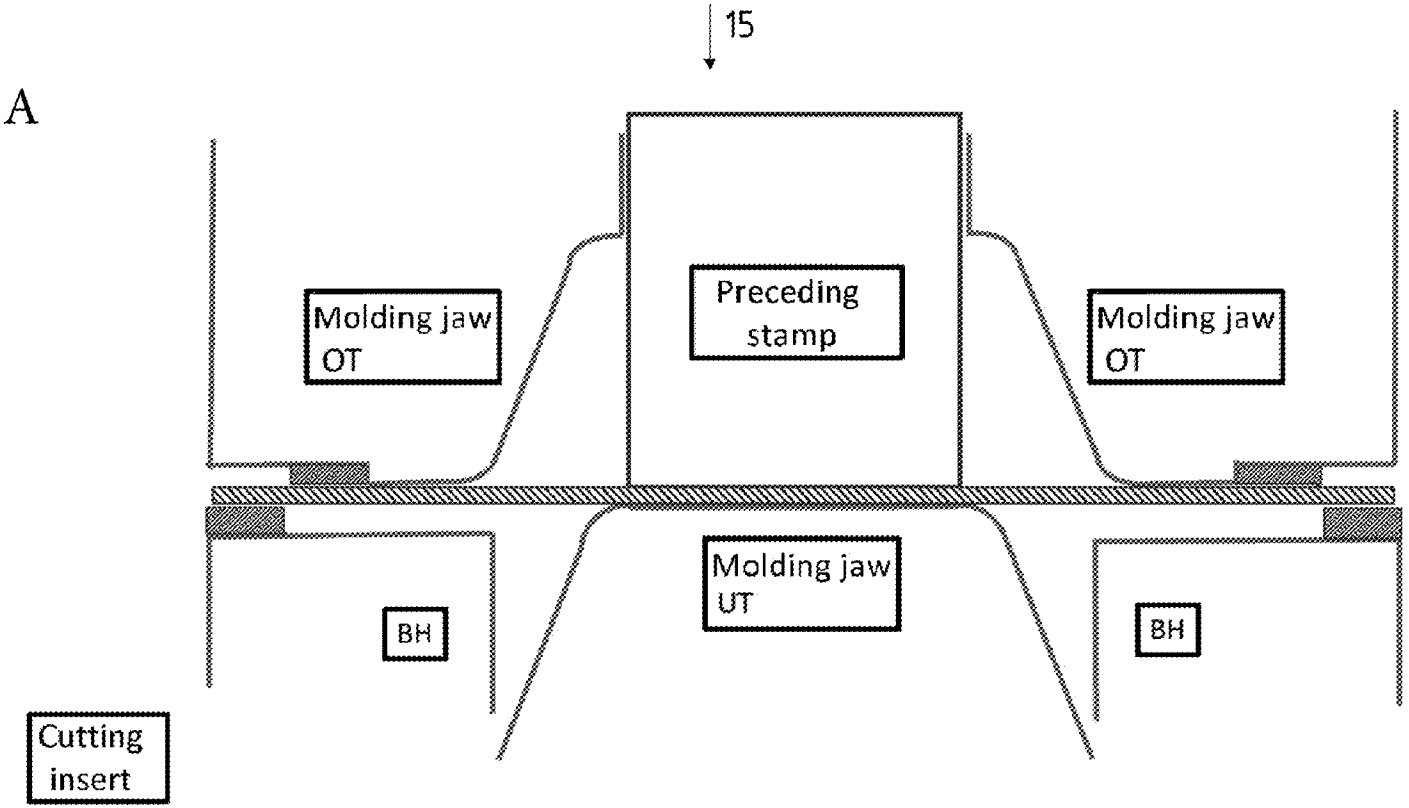
FIGS. 3A-3D show the production of a motor vehicle component 13 as a hat-shaped component according to an embodiment of the disclosure.
Figure 3B:
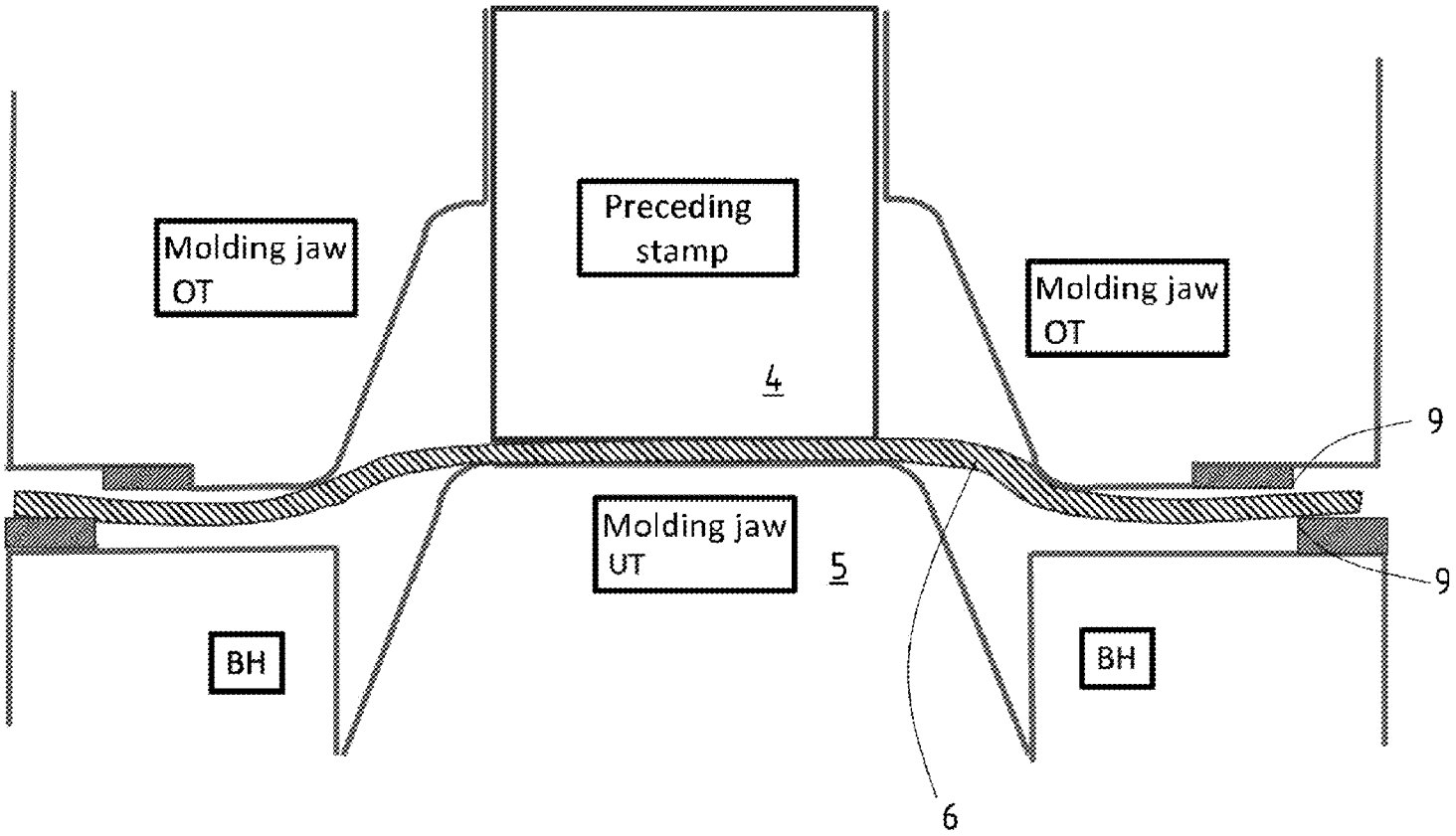
Figure 3C:
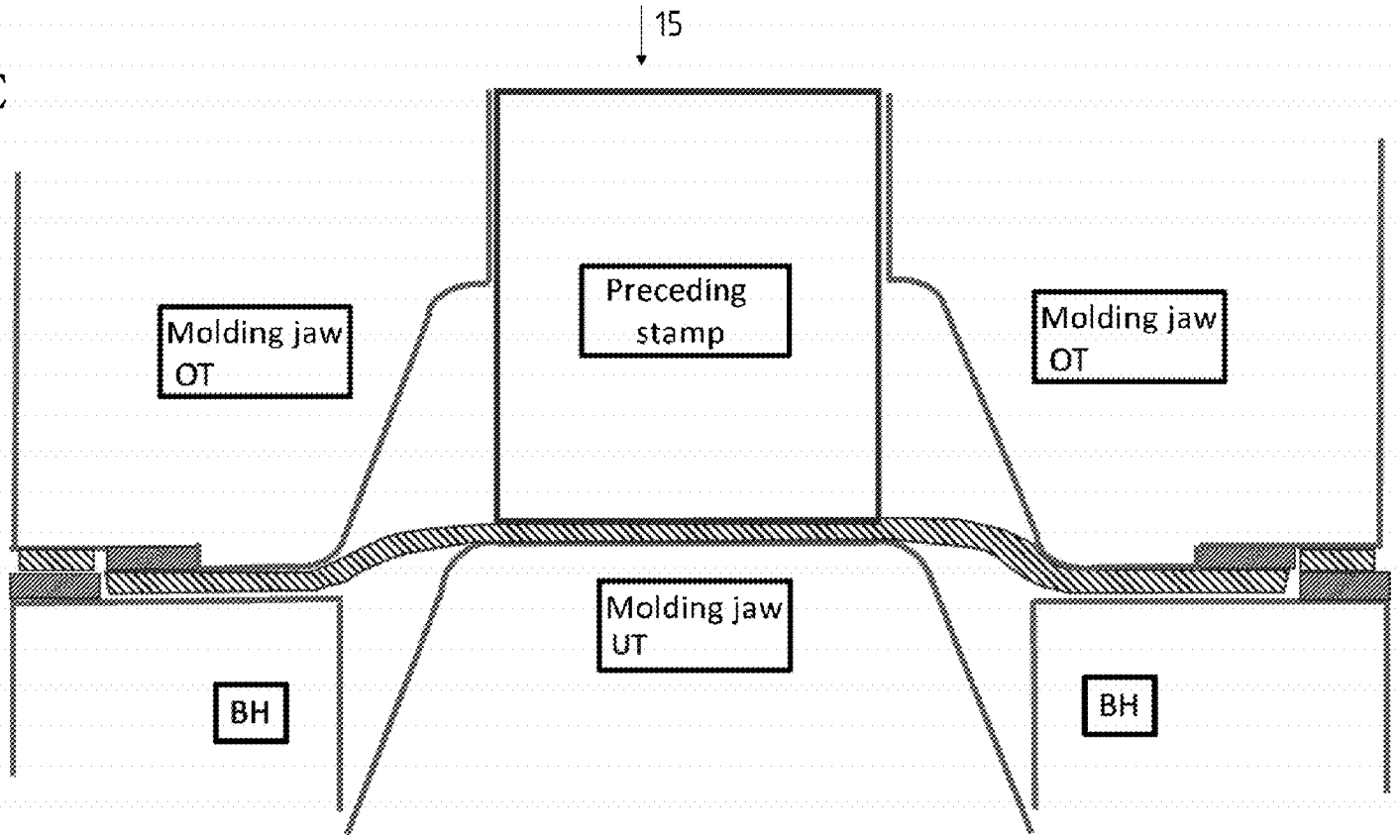
Figure 3D:
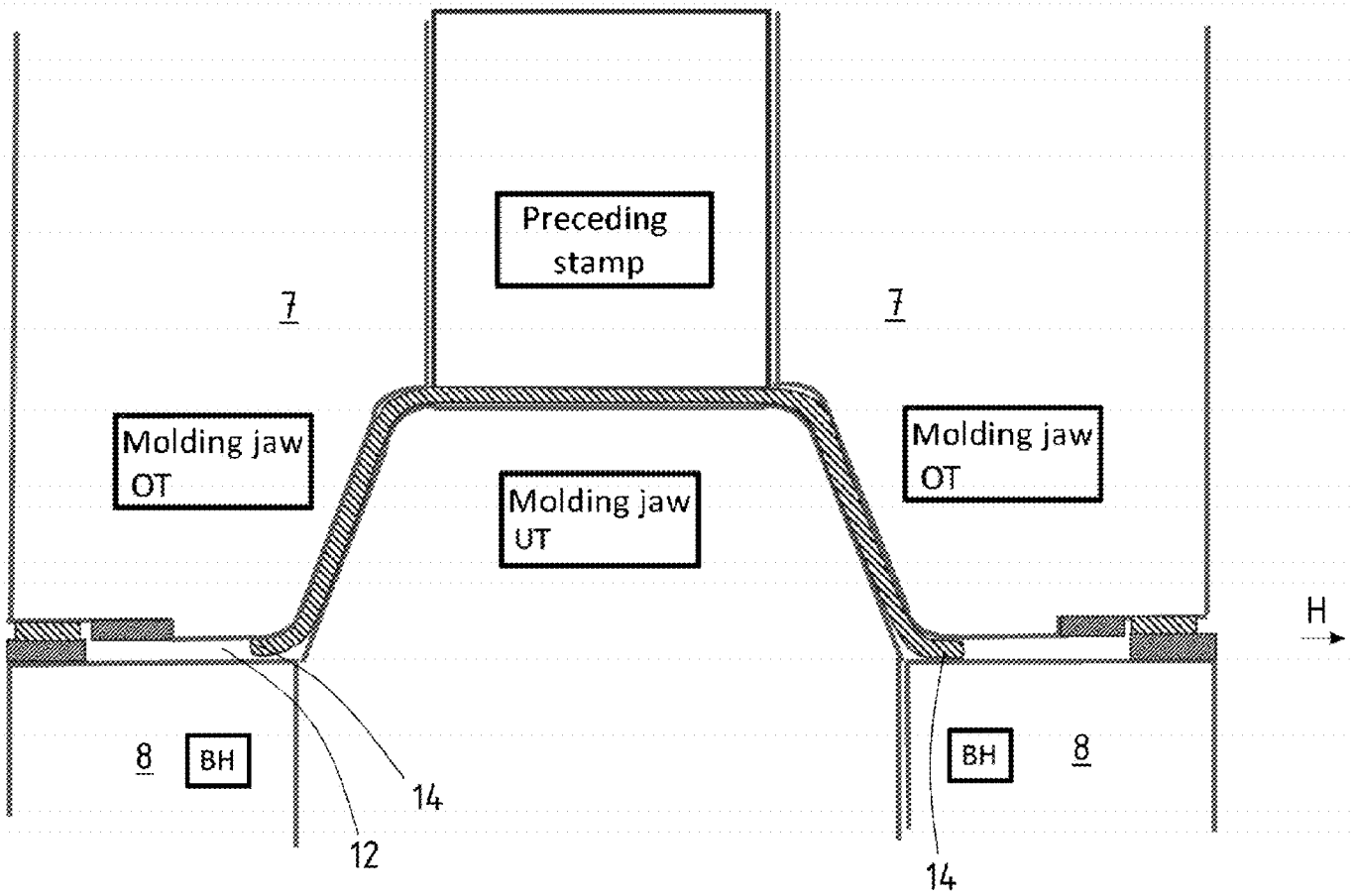

FIGS. 2A-2C show a modification with respect to FIGS. 1A-1C. Also in this instance, the edge cut 10 is carried out completely before the beginning of the forming operation. In contrast to FIG. 1C, however, no motor vehicle component 13 which is U-shaped in cross section is produced here, but instead according to FIG. 2C a motor vehicle component 13 which is hat-shaped in cross section. Outwardly protruding flanges 14 protrude in the horizontal direction H. To this end, the lower metal sheet holder 8 is constructed to be wider and also serves to form a molding hollow space 12 when the upper tool 2 has been lowered completely at the bottom dead center position.

FIGS. 3A-3D show the production of a motor vehicle component 13 as a hat-shaped component similarly to FIG. 2C. In this instance, however, the edge cut 10 is carried out only at a later time, approximately at a time at which at least 20 mm still has to be travelled before reaching the bottom dead center position of the forming tool on the path in the press stroke direction 15. Thus, also in this instance according to FIG. 3B, the plate 6 which has been positioned as a result of the preceding stamp 4 is fixed in position on the lower molding jaw. However, the forming operation has already begun according to FIG. 3B. The cutting tools or the opposing cutting edges 9 then carry out the cutting operation according to FIG. 3C. In this instance, the forming operation has then progressed, for example, by up to 20% or the forming tool has been lowered in the press stroke direction 15 by approximately 20% of the path of the press stroke which is intended to be travelled. The edge cut 10 is, however, at this time already completely terminated so that according to FIG. 3D, when the upper molding jaw has been lowered further and formed together with the lower metal sheet holder 8, the motor vehicle component 13 with flanges 14 which protrude outward in a horizontal direction H is then produced in the molding hollow space 12.

Figure 4B:
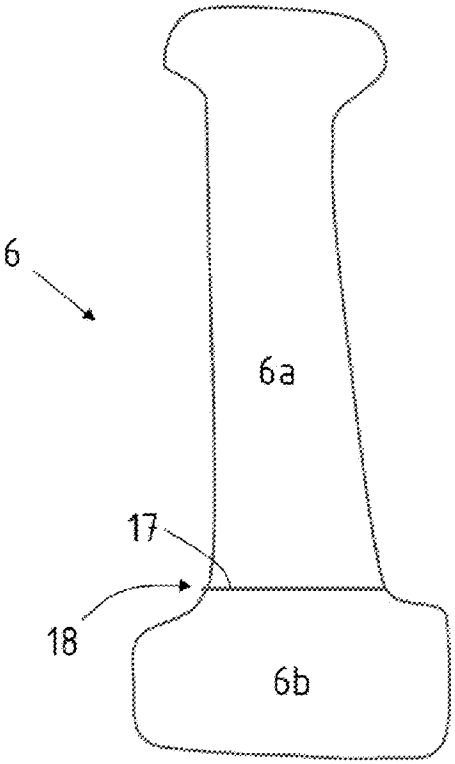
FIG. 4A and FIG. 4B show two prefabricated plate regions according to an embodiment of the disclosure.
Figure 4A:
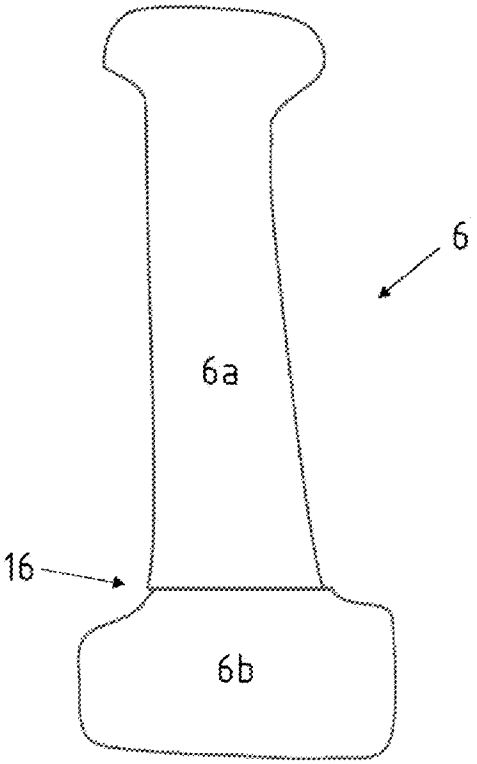

FIG. 4A and FIG. 4B again shows two prefabricated plate blanks. In the case of FIG. 4A, a tailor welded blank. There are two plate regions 6*a* and 6*b* with a different wall thickness. The plate regions 6*a* and 6*b* have an offset 16 with respect to each other. As a result of the circumferential edge cut 10, this offset 16 is able to be disregarded since a circumferential edge which is not illustrated in greater detail in FIG. 4A is subsequently cut once again during the method according to the disclosure and no ultimate edge cut 10 or the like would have to be carried out.

In the case of FIG. 4B, a plate 6 is also shown as a tailor welded blank. A weld seam 17 which connects the two plate regions 6*a* and 6*b* has a lateral overhanging weld seam overhang 18. In the case of the circumferential edge cut 10, this weld seam overhang 18 is also cut away.

The foregoing description of some embodiments of the disclosure has been presented for purposes of illustration and description. The description is not intended to be exhaustive or to limit the disclosure to the precise form disclosed, and modifications and variations are possible in light of the above teachings. The specifically described embodiments explain the principles and practical applications to enable one ordinarily skilled in the art to utilize various embodiments and with various modifications as are suited to the particular use contemplated. Various changes, substitutions and alterations can be made hereto without departing from the spirit and scope of the disclosure.

The invention claimed is:

1. A method of making a motor vehicle component, the method comprising: heating a plate comprising a hardenable steel sheet alloy to a temperature greater than an Ac1 temperature or an Ac3 temperature of the steel alloy; inserting the plate, after the heating, in a combined forming-and-cutting tool, the cutting occurring before the forming; fixing the plate, after the inserting, in the forming-and-cutting tool using a stamp arranged in the forming-and-cutting tool; and performing, in a single press stroke of the forming-and-cutting tool, hot-cutting, hot-forming, and press-hardening of the plate to obtain the motor vehicle component, wherein the hot-cutting comprises cutting at least partially a circumferential edge of the plate before beginning the hot-forming, or during the hot-forming, in a time period of up to 50% of progression of the hot-forming, wherein the cutting is completed at at least 20 mm before the press stroke reaching a bottom dead center position of the forming-and-cutting tool;

wherein the cutting is performed by cutting edges arranged on a lower metal sheet holder on opposite sides of a lower molding jaw of the forming-and-cutting tool, the forming-and-cutting tool further comprises an upper molding jaw which is lowered to press the plate against the cutting edges and cause the cutting edges to perform the cutting, and after the cutting has been completed, the lower metal sheet holder is lowered, together with the upper molding jaw, relative to the lower molding jaw.

2. The method according to claim 1, wherein the cutting comprises cutting an entire circumferential edge of the plate.

3. The method according to claim 1, wherein the cutting severs a wall thickness of the plate.

4. The method according to claim 1, wherein the motor vehicle component is U-shaped or hat-shaped in cross-section.

5. The method according to claim 1, wherein the cutting is performed at from 550° to 750° C.

6. The method according to claim 1, wherein, upon completion of the cutting, the plate has been completely drawn into an interior of the forming-and-cutting tool.

7. The method according to claim 1, wherein the plate is a tailor welded blank has at least two regions with at least one of (i) mutually different wall thicknesses, or (ii) mutually different steel alloys.

8. The method according to claim 1, wherein, in the fixing, the stamp presses the plate to a lower molding jaw of the forming-and-cutting tool.

9. The method according to claim 1, wherein the stamp and tool components of the forming-and-cutting tool in contact with the plate undergo active cooling during the press-hardening.

10. The method according to claim 1, wherein, in the heating, the plate is heated to a temperature greater than 500° C.

11. The method according to claim 1, wherein at least one of the Ac1 temperature is greater than 700° C., or the Ac3 temperature is greater than 900° C.

12. The method according to claim 1, wherein the cutting is completed before beginning the hot-forming, and the hot-forming results in a flange-free motor vehicle component which is U-shaped in cross section.

13. The method according to claim 1, wherein the cutting is performed and completed during the hot-forming, in the time period of less than 50% of the progression of the hot-forming.

14. The method according to claim 1, wherein the cutting is performed and completed during the hot-forming, in the time period of less than 20% of the progression of the hot-forming.

15. The method according to claim 1, wherein the cutting is performed and completed while the plate is still completely in a planar state.

16. The method according to claim 1, wherein the cutting is completed at at least 30 mm before the press stroke reaching the bottom dead center position of the forming-and-cutting tool.

17. The method according to claim 1, wherein the cutting is completed at at least 100 mm before the press stroke reaching the bottom dead center position of the forming-and-cutting tool.

18. The method according to claim 1, wherein the plate is a tailor welded blank comprising at least two plate regions having different thicknesses, and wherein the cutting cuts through the at least two plate regions to form a component edge of the motor vehicle component.

19. The method according to claim 1, wherein the stamp is arranged on an upper tool of the forming-and-cutting tool and is lowered to clamp the plate against a lower molding jaw of the forming-and-cutting tool before the cutting begins, thereby fixing the plate in position in a horizontal direction.

* * * * *